US008079925B2

(12) United States Patent
Englert et al.

(10) Patent No.: US 8,079,925 B2
(45) Date of Patent: Dec. 20, 2011

(54) CONCEPT FOR ACTIVATING A GAME DEVICE

(75) Inventors: Walter Englert, Burgrieden (DE); Tilman Bucher, Munich (DE)

(73) Assignee: Cairos Technologies AB, Karlsbad (DE)

( * ) Notice: Subject to any disclaimer, the term of this patent is extended or adjusted under 35 U.S.C. 154(b) by 1108 days.

(21) Appl. No.: 11/735,886

(22) Filed: Apr. 16, 2007

(65) Prior Publication Data

US 2008/0090683 A1 Apr. 17, 2008

(30) Foreign Application Priority Data

Oct. 12, 2006 (DE) ..... 10 2006 048 387

(51) Int. Cl.
*A63B 43/06* (2006.01)

(52) U.S. Cl. ..... 473/570; 473/569

(58) Field of Classification Search ..... 473/57
See application file for complete search history.

(56) References Cited

U.S. PATENT DOCUMENTS

| | | | | |
|---|---|---|---|---|
| 5,564,698 | A * | 10/1996 | Honey et al. | 473/570 |
| 5,748,073 | A * | 5/1998 | Crawford | 340/323 R |
| 5,863,255 | A * | 1/1999 | Mack | 473/152 |
| 5,976,038 | A * | 11/1999 | Orenstein et al. | 473/467 |
| 6,151,563 | A * | 11/2000 | Marinelli | 702/141 |
| 6,476,708 | B1 * | 11/2002 | Johnson | 340/10.34 |
| 6,570,487 | B1 * | 5/2003 | Steeves | 340/5.2 |
| 2004/0160355 | A1 * | 8/2004 | Bervoets et al. | 342/42 |
| 2005/0159252 | A1 | 7/2005 | Fergestad et al. | |
| 2007/0032314 | A1 * | 2/2007 | Ratcliffe | 473/353 |
| 2008/0074109 | A1 * | 3/2008 | Tsukada et al. | 324/234 |

FOREIGN PATENT DOCUMENTS

| | | |
|---|---|---|
| DE | 2732543 A1 | 2/1979 |
| WO | WO 00/47291 | 8/2000 |
| WO | WO 2004/076003 | 9/2004 |
| WO | WO 2006/094508 | 9/2006 |

* cited by examiner

*Primary Examiner* — Melba Bumgarner
*Assistant Examiner* — Tramar Harper
(74) *Attorney, Agent, or Firm* — Michael A. Glenn; Glenn Patent Group

(57) ABSTRACT

A game ball wherein in the vicinity of a goal, or in a goal area, an electronic system is activated in the goal area by an activation signal, which may be a magnetic field or a radio signal, so as to subsequently facilitate, e.g., highly precise position measurement of the game device, or game ball.

11 Claims, 4 Drawing Sheets

CONCEPT FOR ACTIVATING A GAME DEVICE

CROSS-REFERENCE TO RELATED APPLICATIONS

This application claims priority from German Patent Application No. 102006048387.1, which was filed on Oct. 12, 2006, and is incorporated herein in its entirety by reference.

TECHNICAL FIELD

The present invention relates to a concept for activating a game device as may be employed, in particular, for activating a football, or soccer ball, in a football, or soccer, match.

BACKGROUND

A number of tasks, such as ball localization in a football, or soccer, match, presuppose knowledge of the positions and/or orientations of objects. In a football match, one of the most controversial topics is whether or not in critical situations the ball has crossed the goal line. To this end, it is necessary that the position of the ball at the goal line may be measured with an accuracy of approximately +/−1.5 cm.

Positioning, or ball localization, may be effected, for example, by means of magnetic fields which may be generated in the vicinity of the goal area, e.g. by means of coils at and/or in the goal posts. If a game device, or a ball, exhibits a magnetic-field sensor, a statement may be made, on the basis of determining the field strengths of the magnetic fields generated by the coils, as to whether or not the ball has crossed the goal line.

Since in a football match, a football may reach speeds of up to 140 km/h, it should be possible, for position measurement in order to make goal decisions, to determine a position of the ball with a very high level of accuracy, particularly in the vicinity of the goal. For example, this necessitates activating a high sampling rate of a reader for reading out the magnetic-field sensor for detailed and exact measurement of the magnetic field in the goal area.

SUMMARY

According to an embodiment, a game ball may have a magnetic-field sensor; a reader of reading out the magnetic-field sensor; an activation signal detector for detecting an activation signal; and a controller for controlling the reader so that reading-out will be performed at a first sampling rate if an activation is detected on account of the activation signal, and reading-out will be performed at a second, smaller sampling rate if no activation is detected.

According to another embodiment, a method of activating a game ball including a magnetic-field sensor may have the steps of: detecting a ball activation signal; and controlling a reader for reading out the magnetic-field sensor, so that reading-out will be performed at a first sampling rate if an activation is detected on account of the activation signal, and reading-out will be performed at a second, smaller sampling rate if no activation is detected.

According to another embodiment, a computer program including a program code for performing a method of activating a game ball including a magnetic-field sensor, wherein the method may have the steps of: detecting a ball activation signal; and controlling a reader for reading out the magnetic-field sensor, so that reading-out will be performed at a first sampling rate if an activation is detected on account of the activation signal, and reading-out will be performed at a second, smaller sampling rate if no activation is detected, when the program runs on a computer.

The present invention is based on the findings that an electronic system in a game device, or in a game ball, in the vicinity of a goal, or in a goal area, is activated by an activation signal in the goal room so as to subsequently facilitate, for example, highly accurate position measurement of the game device, or game ball.

In accordance with a first embodiment of the present invention, a game device, or a ball, located in the vicinity of a goal may be activated via a magnetic field. In this context, the magnetic field at the goal is generated, for example, by means of coils in or at the goal posts and/or behind the goal. When the ball comes close to the goal, this is detected by a magnetic-field sensor integrated into the ball, the ball conducting magnetic-field measurements outside of a range of the activation signal or of the magnetic field, for example at a low sampling rate so as to save current. As soon as the magnetic field generated by the coils is measured in the goal area, a measurement system, or an electronic system, within the ball will switch to a higher sampling rate to record measurement data with regard to the magnetic field at shorter time intervals and, thus, at a higher resolution.

In accordance with a second aspect of the present invention, the higher sampling rate of the ball's electronic system may be activated by a radio signal, in particular a weak radio signal, in the vicinity of the goal; to this end, a radio transmitter is mounted in the vicinity of the goal, or at the goal, so as to send out the radio signal for activating the ball. In this aspect, the ball comprises a radio receiver tuned to the radio signal.

In the inventive concept, a magnetic-field detection, in particular a highly accurate magnetic-field detection, is thus switched on only when necessary. This is the case, for example, when the ball is located in the vicinity of the goal. If the ball is located outside the range of the magnetic field prevailing in the goal area, the electronic system within the ball will be set to an energy-saving mode, for example by means of a smaller sampling rate.

In accordance with one embodiment, in the energy-saving mode, it is continuously but in a very power-saving manner, at a low sampling rate, that the ball measures a magnetic field which prevails at the location of the ball and which may be—outside the goal area—the earth's magnetic field, for example. As was already described above, the magnetic field generated by the coils for the purpose of goal detection, or the radio signal for activation, can only be detected at a relatively small distance from the goal. As soon as the ball, or the magnetic field sensor or radio receiver present within the ball, detects this magnetic field, or the radio signal, a switch is made to a higher or maximum sampling rate of the ball's electronic system.

One advantage of the present invention is that the electronic system is not activated, for the purpose of high-resolution detection of a magnetic field, until it is necessary. For this reason, it is possible to save energy, and thus to ensure a longer lifetime of a battery for supplying the ball with energy, during time periods when no highly accurate measurements are necessary.

BRIEF DESCRIPTION OF THE DRAWINGS

Embodiments of the present invention will be detailed subsequently referring to the appended drawings, in which.

DETAILED DESCRIPTION

Figure 1:
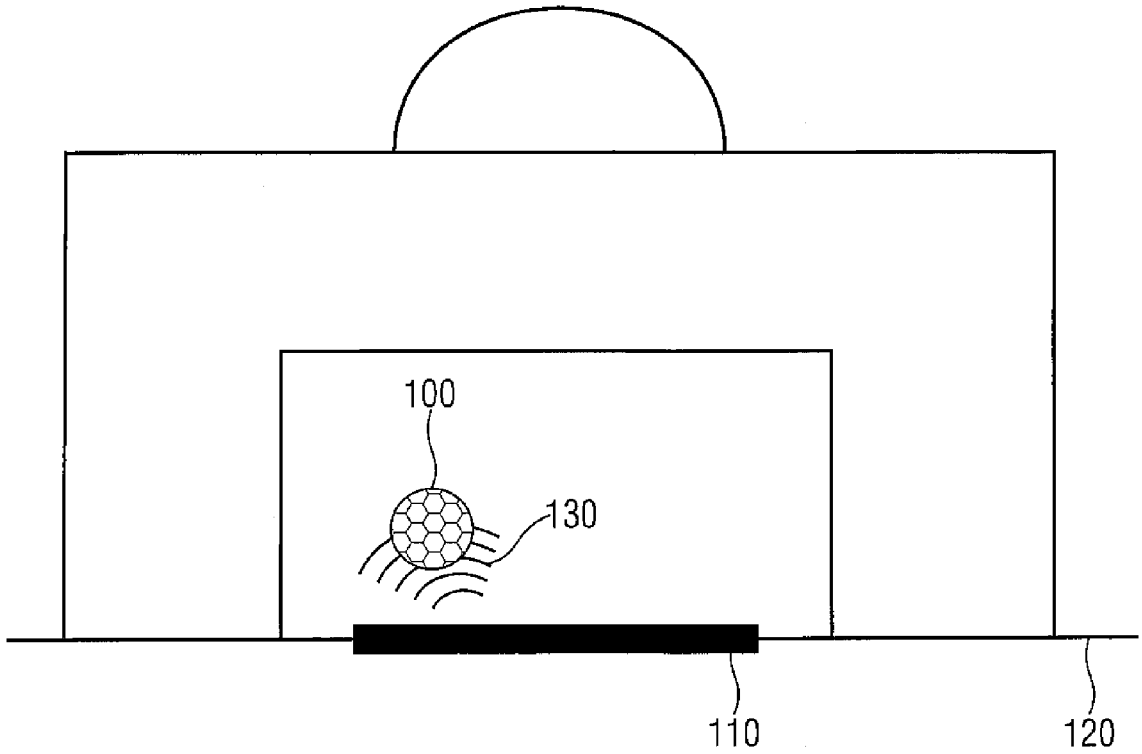
FIG. 1 is a schematic representation of a ball in a goal area for illustrating the inventive concept.

With regard to the following description, it should be noted that functional elements which are identical or have identical actions are designated by identical reference numerals in the various embodiments, and that, as a consequence, the descriptions of these functional elements are mutually exchangeable in the various embodiments represented below.

FIG. 1 shows a game ball 100 in close proximity of a football goal 110 located on a goal line 120. In a predefined area around goal 110, an activation signal 130 may be received by ball 100 so as to switch on a measurement electronic system within game ball 100, or to increase a sampling rate of the measurement electronic system.

In accordance with embodiments, the activation signal 130 may be a magnetic field, in particular an alternating magnetic field different from the earth's magnetic field and measurable in a predetermined area around goal 110. The magnetic field, which is generated, for example, by coils mounted to goal 110, may also be used to make a goal decision, i.e. a decision as to whether ball 100 has crossed goal line 120.

In accordance with a further embodiment, activation signal 130 may also be a weak radio signal which is receivable in the predetermined area around goal 110. To this end, a suitable radio transmitter, for example, will be located in the vicinity of goal 110 in order to send out the radio signal.

Whether or not the activation signal 130 is a magnetic field generated by the coils at the goal, or is a radio signal will have its effects on the electronic system within ball 100. Various embodiments of game ball 100 in accordance with the present invention will be explained below in more detail with reference to FIGS. 3 and 4. Prior to that, a method of activating game ball 100 in accordance with an embodiment of the present invention shall be explained in more detail with reference to FIG. 2. In a step S200, a ball activation signal 130 is detected by ball 100, it being possible for said signal to be a magnetic field or a radio signal, as was already described above. In a subsequent step S210, a reader is controlled to read out a magnetic-field sensor within the ball, on the basis of activation signal 130.

In accordance with an embodiment of the present invention, if activation signal 130 is a radio signal, the reader may be switched on for reading out the magnetic-field sensor in case the radio signal is present, or a sampling rate of the reader may be changed to a higher sampling rate. P In the event that ball activation signal 130 is a magnetic field generated by the coils at goal 110, step 200 is preceded by two additional steps S180 and S190. In step S180, the ball measures, at a low, current-saving sampling rate, a magnetic field surrounding it, using the magnetic-field sensor integrated within the ball, so as to read out those values which have been measured by the magnetic-field sensor with a reader in step S190. Not until magnetic-field measurement values, or magnetic-field strength values, are detected via a first threshold value will the ball activation, or the activation of the higher sampling rate, be triggered by this. In this context, the first threshold value may be larger, in accordance with embodiments, than a magnitude of the earth's magnetic field at the earth's surface at a location of game ball 100. At the earth's surface, the earth's magnetic field is relatively weak. It varies between 60 microtesla at the poles and about 30 microtesla at the equator. In central Europe, it amounts to about 48 microtesla, about 20 microtesla being present in the horizontal and about 44 microtesla in the vertical directions. In accordance with embodiments, a suitable range of values of from 40 to 70 microtesla thus results for the first threshold value. An alternating magnetic field may already be detected, on the basis of its frequency, at smaller field strengths, quasi as a modulation field of the earth's magnetic field.

Figure 2:
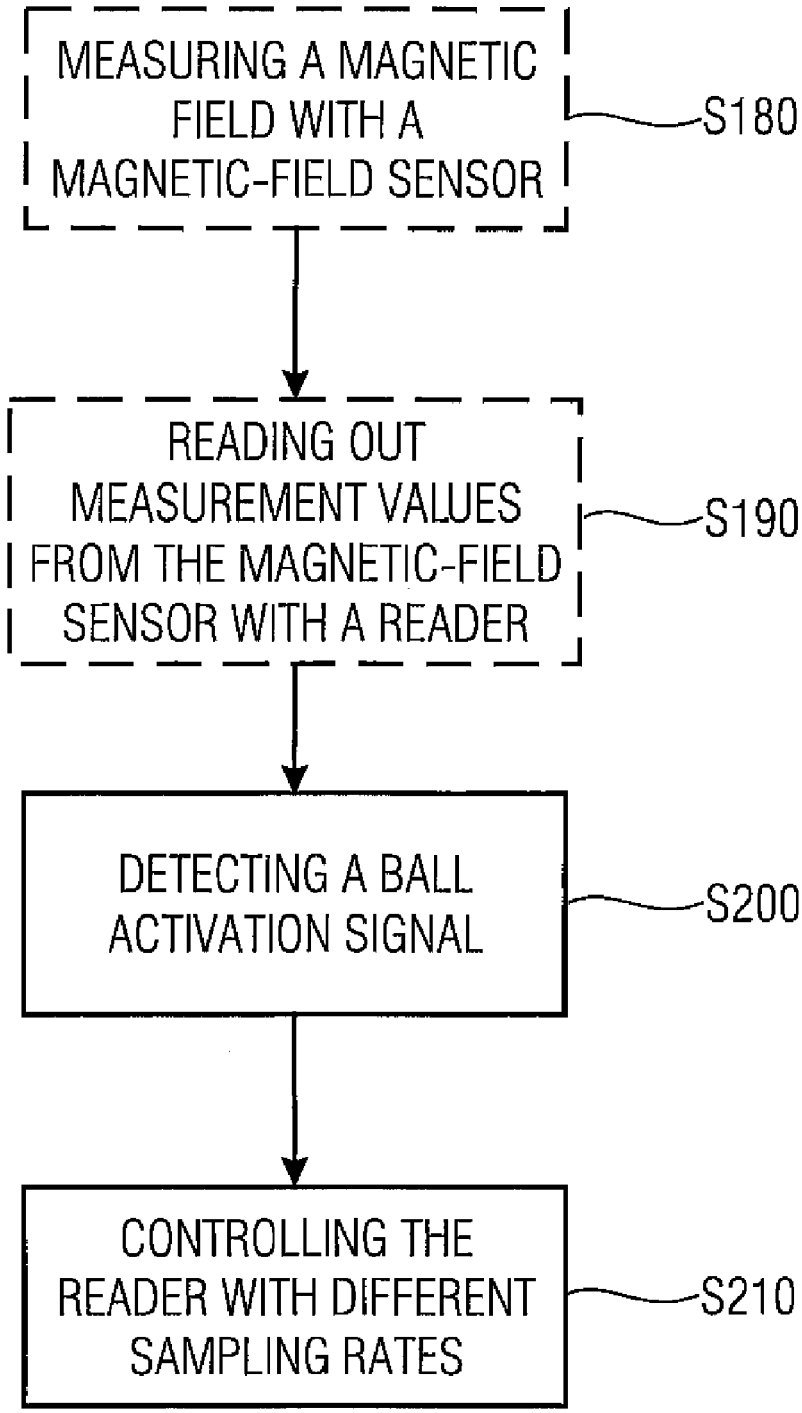
FIG. 2 is a flow chart for illustrating a method of activating a game ball in accordance with an embodiment of the present invention.
Figure 3:
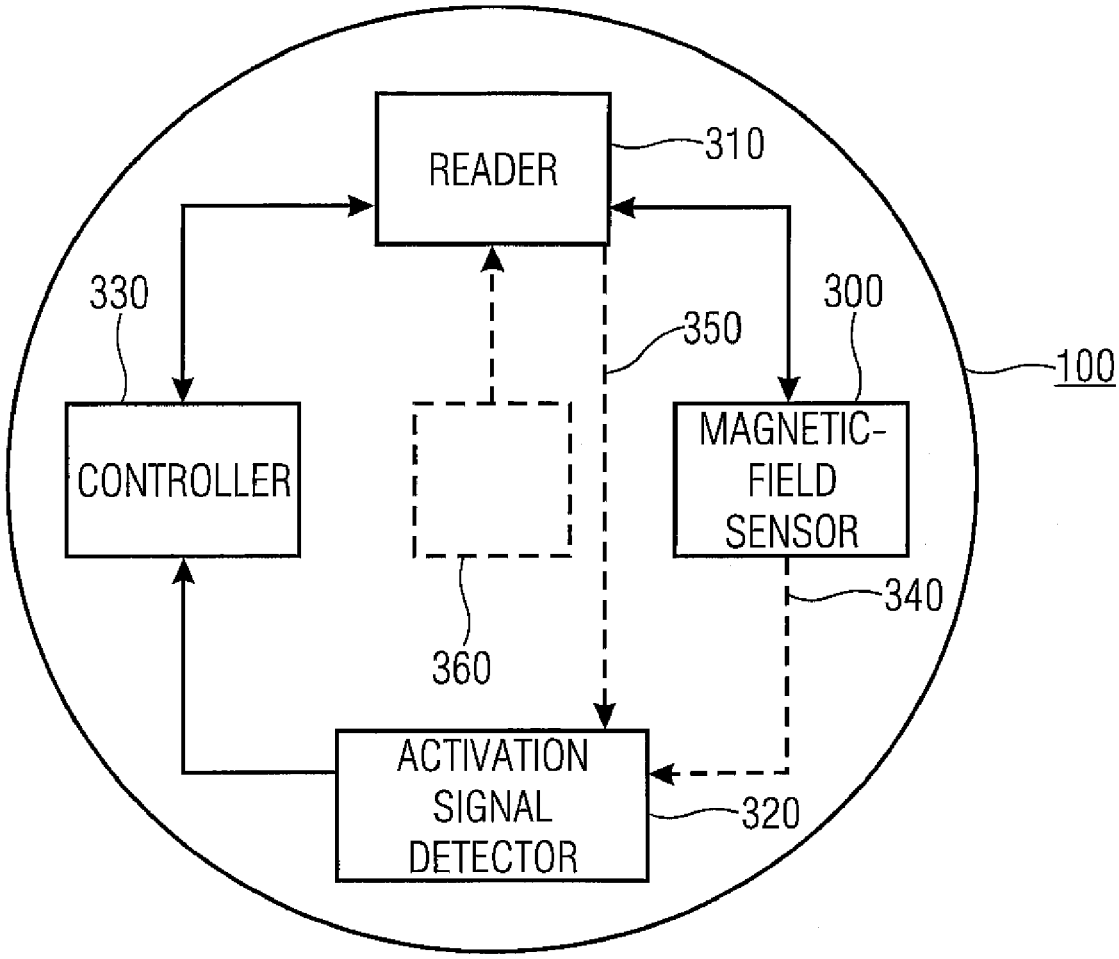
FIG. 3 depicts a game ball in accordance with an embodiment of the present invention.

A game ball 100 in accordance with embodiments of the present invention for performing the method schematically shown in FIG. 2 is represented in FIG. 3.

Game ball 100 comprises a magnetic-field sensor 300, a reader 310 for reading out the magnetic-field sensor, an activation signal detector 320 for detecting an activation signal 130, and a controller 330 for controlling reader 310.

Activation signal detector 320 is coupled to controller 330 so that in the event that an activation signal 130 is present, reader 310 will read out magnetic-field sensor 300 at a first sampling rate, and in the event that the activation system is not present, reader 310 will read out the magnetic-field sensor at a second, smaller sampling rate. In this context, controller 330 takes over the sampling rate control of reader 310. In accordance with embodiments, controller 330 is configured to adjust the first sampling rate to be at least 10 times higher, advantageously at least 100 times higher, than the second sampling rate.

In accordance with embodiments, magnetic-field sensor 300 is a three-dimensional magnetic-field sensor, i.e. it can measure magnetic field strength components ($H_x$, $H_y$, $H_z$) in accordance with the three space coordinates (x, y, z), which later may also be used for forming the magnitude of a field strength in accordance with $|H|=\sqrt{H_x^2+H_y^2+H_z^2}$. Magnetic-field sensor 300 may comprise Hall sensors or magnetoresistive elements. In addition, magnetic-field sensor 300 may already have an analog/digital converter integrated therein.

Figure 4A:
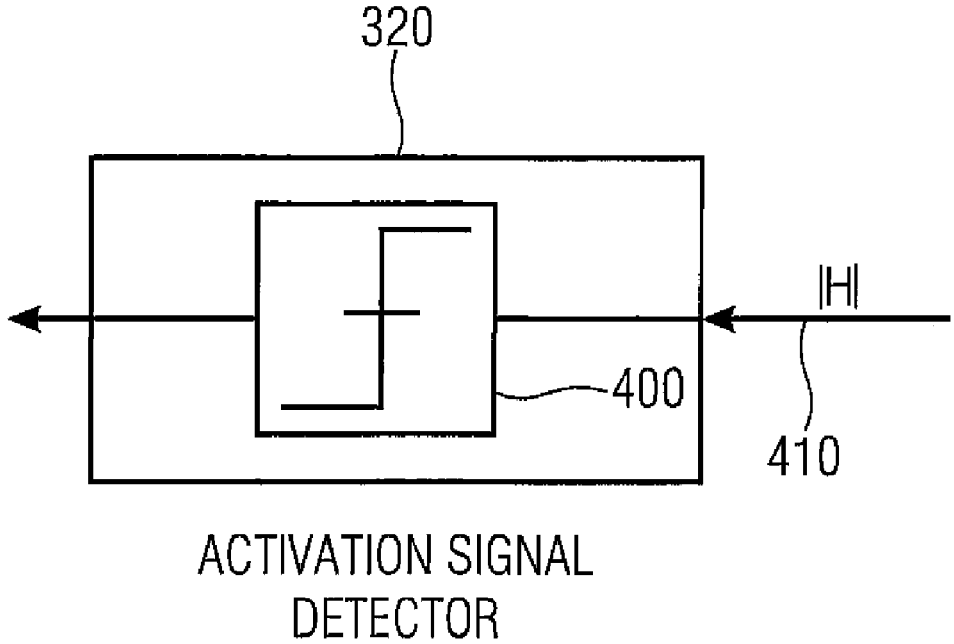
FIGS. 4*a* and 4*b* show two embodiments of an activation signal detector.

In the event that ball 100 is activated via the magnetic field generated in the goal area by coils, activation signal detector 320 is coupled to magnetic-field sensor 300 or to reader 310 for reading out the magnetic-field sensor, as is indicated by reference numerals 340 and 350, respectively. In this case, activation signal detector 320 comprises, in accordance with embodiments, a means for comparing magnetic-field measurement values measured by magnetic-field sensor 300 as the activation signal 130 with the first threshold value, as is schematically shown in FIG. 4*a*. In this context, the means for comparing may be a threshold-value decision maker.

FIG. 4*a* depicts an activation signal detector 320 comprising a threshold-value decision maker 400, field strength measurement values 410 being conducted at an input of activation signal detector 320, or of threshold-value decision maker 400. These field strength measurement values may be sent directly from magnetic-field sensor 300 to activation signal detector 320 via coupling link 340, or from reader 310 via coupling link 350. In accordance with embodiments, field strength measurement values 410 correspond to the magnitude of |H| of the magnetic field measured at the location of ball 100. If the magnetic field strength measured exceeds the first threshold value, a signal will be forwarded to controller 330, as a result of which, controller 330 will control reader 310 for reading out the magnetic-field sensor 300 at a higher sampling rate than in the event that the radio signal is not present.

With an alternating magnetic field as the activation signal, threshold-value decision maker 400 may also verify the presence of a frequency in the magnetic field strength measurement values.

Figure 4B:
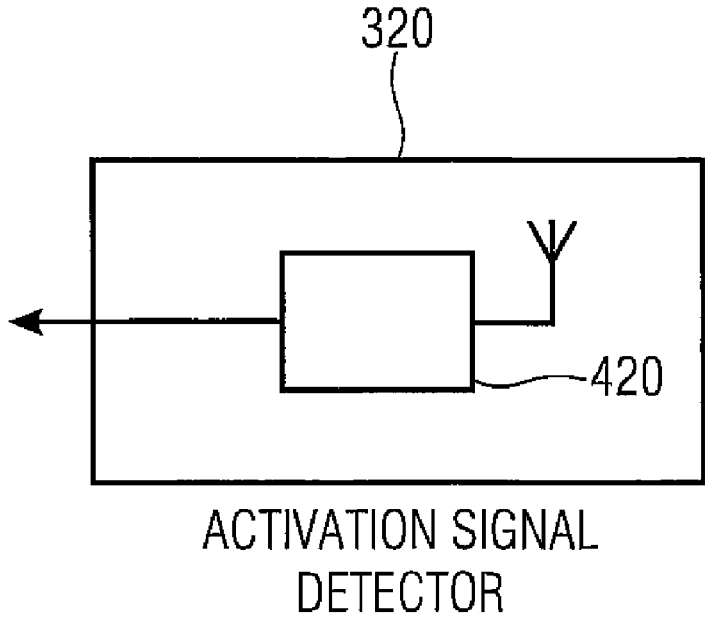

If the ball activation, or the change in the sampling rate, is to be conducted on the basis of a radio signal as the activation signal 130, activation signal detector 320 in accordance with embodiments further comprises a radio receiver for receiving the radio signal as the evaluation signal, as is schematically depicted in FIG. 4*b*.

FIG. 4*b* depicts an activation signal detector 320 comprising a radio receiver 420. Radio receiver 420 may be configured in a very simple manner so as to perform, for example, only an RF power detection in a predefined frequency domain. If the RF power received exceeds a first RF power threshold value within the frequency band provided for the radio signal, a signal will be passed on to controller 330, as a result of which controller 330 will control reader 310 for reading out the magnetic-field sensor 300 at a higher sampling rate than in the event that the radio signal is not present. Here, too, activation signal detector 320 may also comprise a threshold-value decision maker so as to trigger the signal to controller 330 in the event that an RF power threshold value is exceeded.

Thus, if an activation is detected on account of an activation signal being present, i.e. of a magnetic field or a radio signal being present, magnetic-field sensor 300 will be read out at a first sampling rate, and if no activation is detected, magnetic-field sensor 300 will be read out at a second, smaller sampling rate. In the event of the activation being effected by the radio signal, the second sampling rate may also be zero, i.e. no magnetic-field measurement will be performed whatsoever if the activation signal is not present.

In accordance with embodiments of the present invention, game ball 100 may further comprise a radio transmitter for transmitting the read-out magnetic-field values to a central evaluating device, as is indicated by reference numeral 360. The central evaluating device may make a goal decision, for example, by means of the magnetic-field values.

Also, game ball 100 may further comprise a memory for storing the read-out magnetic-field values. Thus, a decision may be made, for example, after the end of the match or after a goal situation, as to whether or not a goal was scored by reading out the memory.

In summary, the inventive concept provides a possibility of activating a game device, in particular a game ball, in the vicinity of a goal via an activation signal which may be, for example, a weak radio signal present in a goal area or a magnetic field generated by coils mounted to the goal. To this end, in accordance with embodiments, the ball comprises an activation signal detector which either receives magnetic-field measurement values 410 at a small sampling rate from magnetic-field sensor 300 or magnetic-field sensor reader 310, or receives the radio signal as the activation signal and thereupon increases, via control means 330, a sampling rate of the magnetic-field measurement system within the ball in the vicinity of the goal.

In accordance with an embodiment of the present invention, magnetic-field sensor 300 is read-out, for example, every 100 milliseconds (ms) in case activation signal 130 is not present. As soon as the activation signal is detected by ball 100 or by activation signal detector 320, magnetic-field sensor 300 will be read out at substantially shorter time intervals, for example at time intervals smaller than 1 ms.

In the inventive concept, a higher sampling rate is only ever switched on for a short time, namely for as long as the activation signal 130 (magnetic field, radio signal) is receivable by ball 100, so as to save energy. If ball 100 has not detected any activation signal for a very long time, for example, one day, controller 330 will control the sampling rate of magnetic-field sensor 300 in such a manner, for example, that measurement values will only be read every 10 seconds.

In this way, the energy consumption of the ball may again be drastically reduced. Since, in accordance with one embodiment of the present invention, the state of a battery within ball 100 may be queried, it is ensured that the sampling rate within ball 100 is re-set, for example, to 100 milliseconds or 10 Hz at the beginning of a match.

In accordance with an embodiment of the present invention, the current supply within ball 100 may be designed for, for example, 300 hours of active playing time. In a so-called power-down mode, the battery of ball 100 may be designed to have a lifetime of, e.g., three years. By using a battery, expensive accumulator-charging technology can be completely dispensed with.

It shall be noted at this point that the energy supply of ball 100 could naturally also be effected without any battery by means of accumulators which may be charged, for example, by natural processes such as incident light radiation or motion. This may be effected, e.g., by means of induction within a coil. However, this would necessitate relatively expensive charging technology.

Using the inventive concept, one cannot detect the number of balls present in the match. Throw-in of the ball into the pitch cannot be detected. Ball 100 will not be detcted as the game ball until it is located in close proximity to goal 110. However, positions behind the goal may be detected. If the ball crosses goal line 120, a goal can be detected and indicated. A detection of whether the ball is located behind the goal may be effected, for example, in that in this case a field strength of a coil behind the goal is disproportionately high as compared to the field strengths of coils at/within the goal frame. To detect this, the ball, or activation signal detector 320, comprises, in accordance with embodiments, a means for comparing the magnetic-field measurement values to a second threshold value larger than the first threshold value, so as to prevent, or switch off, an activation if the second threshold value is exceeded. If the second threshold value is exceeded, this is an indicator that the ball is located behind the goal. This concept may also be applied to activation by means of a radio signal, the transmitter of the radio signal being positioned behind the goal, and thus a larger field strength of the radio signal being measurable behind the goal than in front of the goal. To this end, the ball, or activation signal detector 320, comprises, in accordance with embodiments, a means for comparing radio power received by receiver 420 to a second RF power threshold value larger than the first RF power threshold value, so as to prevent activation when the second threshold value is exceeded.

Finally, it shall be noted that the present invention is not limited to the respective components of game ball 100 or to the approach illustrated, and that these components and methods could vary. The terms used here are only intended to describe specific embodiments and shall not be used in a limiting sense. When the singular form or indefinite articles are used in the description and in the claims, they shall refer to the plural of these elements unless the overall context clearly indicates otherwise. The same also applies vice versa.

Depending on the circumstances, the inventive methods may be implemented in hardware or in software. Implementation may be performed on a digital storage medium, e.g. a disc or CD comprising electronically readable control signals, which may interact with a programmable computer system in such a manner that the respective method is performed.

Generally, the invention thus also consists in a computer program product comprising a program code, stored on a machine-readable carrier, for performing the inventive method, when the computer program product runs on a computer and/or micro-controller. In other words, the present invention thus also is a computer program having a program code for performing the method for ball activation, when the computer program runs on a computer and/or micro-controller.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A game apparatus comprising:

a game ball comprising a plurality of components fitted therein, said components comprising:

a magnetic-field sensor, wherein the magnetic-field sensor is configured to sense magnetic field values proximate to a goal;

a reader for taking readings from the magnetic-field sensor;

a radio transmitter for transmitting readings of the magnetic field values;

an activation signal detector for detecting an activation signal, wherein activation is triggered when a reading of a magnetic field intensity of read values exceeds a threshold value; and a controller for controlling the reader so that whenever activation is detected on the basis of the activation signal, reading is operated at a first sampling rate, and if no activation is detected, reading is operated at a second, slower sampling rate.

2. The game apparatus as claimed in claim 1, wherein the magnetic-field sensor is a three-dimensional magnetic-field sensor.

3. The game apparatus as claimed in claim 1, wherein the activation signal detector is further adapted to detect an alternating magnetic field as an activation signal.

4. The game apparatus as claimed in claim 1, wherein the activation signal detector compares magnetic-field values measured by the magnetic-field sensor as constituting an activation signal with a first threshold value.

5. The game apparatus as claimed in claim 4, wherein the first threshold value is larger than a magnitude of the earth's magnetic field at the earth's surface at a location of the game ball.

6. The game apparatus as claimed in claim 4, wherein the activation signal detector compares the magnetic-field values to a second threshold value larger than the first threshold value, so as to prevent an activation in case the second threshold is exceeded.

7. The game apparatus as claimed in claim 1, wherein the controller is adapted to set the first sampling rate to be 10 times larger than the second sampling rate.

8. The game apparatus as claimed in claim 1, further comprising:

the goal for detecting when the game ball crosses a goal line, with coils mounted on the goal for generating magnetic fields, the magnetic field values of which are read by the magnetic field sensor fitted into the game ball and forwarded by the radio transmitter to a central evaluation device, wherein the controller controls the sampling rate of the magnetic field sensor as a function of a read magnetic field intensity, and wherein reading is operated at said first sampling rate whenever the magnetic field exceeds a predefined threshold value and reading is operated at said second, slower sampling rate when there is a drop below the predefined threshold value.

9. A method of activating a game ball comprising a magnetic-field sensor, the method comprising the steps of:

measuring a magnetic field using the magnetic-field sensor, wherein the magnetic-field sensor is configured to sense magnetic field values proximate to a goal;

reading out measurement values from the magnetic-field sensor using a reader;

transmitting the measurement values with a radio transmitter to an evaluation unit;

detecting a ball activation signal, wherein activation is triggered due to the fact that the magnetic field intensity of the read magnetic field values has exceeded a magnetic field intensity threshold value; and controlling the reader for reading out the magnetic-field sensor, so that whenever activation is detected on the basis of the activation signal, reading is operated at a first sampling rate, and if no activation is detected, reading is operated at a second, slower sampling rate;

wherein all said steps are performed by components contained within the game ball.

10. The method as claimed in claim 9, wherein the ball activation signal is a magnetic field.

11. A non-transitory computer readable medium having stored thereon a computer program comprising a program code which, when executed by a computer, performs the the steps of:

measuring a magnetic field using the magnetic-field sensor, wherein the magnetic-field sensor is configured to sense magnetic field values proximate to a goal;

reading out measurement values from the magnetic-field sensor using a reader:

transmitting the measurement values with a radio transmitter to an evaluation unit;

detecting a ball activation signal, wherein activation is triggered due to the fact that the magnetic field intensity of the read magnetic field values has exceeded a magnetic field intensity threshold value; and controlling the reader for reading out the magnetic-field sensor, so that whenever activation is detected on the basis of the activation signal, reading is operated at a first sampling rate, and if no activation is detected, reading is operated at a second, slower sampling rate;

wherein all said steps are performed by components contained within a game ball.

* * * * *